United States Patent [19]

Bell

[11] 4,236,704

[45] Dec. 2, 1980

[54] PAPER FOLDING APPARATUS

[76] Inventor: Cyril F. Bell, 4886 Candlewood La., Stone Mountain, Ga. 30088

[21] Appl. No.: 28,339

[22] Filed: Apr. 9, 1979

[51] Int. Cl.[3] ..... B65H 45/22

[52] U.S. Cl. ..... 270/94

[58] Field of Search ..... 270/86, 94, 66, 64, 270/62, 61 R; 162/196, 287; 93/39 R, 48, 52

[56] References Cited

U.S. PATENT DOCUMENTS

| | | | |
|---|---|---|---|
| 474,716 | 5/1892 | Beale et al. | 270/94 |
| 482,153 | 9/1892 | Barrett | 270/86 |
| 3,029,073 | 4/1962 | Wright | 270/86 |
| 3,635,462 | 1/1972 | Joa | 270/86 |
| 4,022,457 | 5/1977 | Marin et al. | 270/86 |

*Primary Examiner*—E. H. Eickholt

*Attorney, Agent, or Firm*—Jones, Thomas & Askew

[57] ABSTRACT

Apparatus for longitudinally folding a paper web. A paper web dispensed from a roll is passed through a plurality of die members. Each die member has slots formed therein to guide the paper web such that distinct folds are progressively made in the paper web as it is passed through the die members.

2 Claims, 1 Drawing Figure

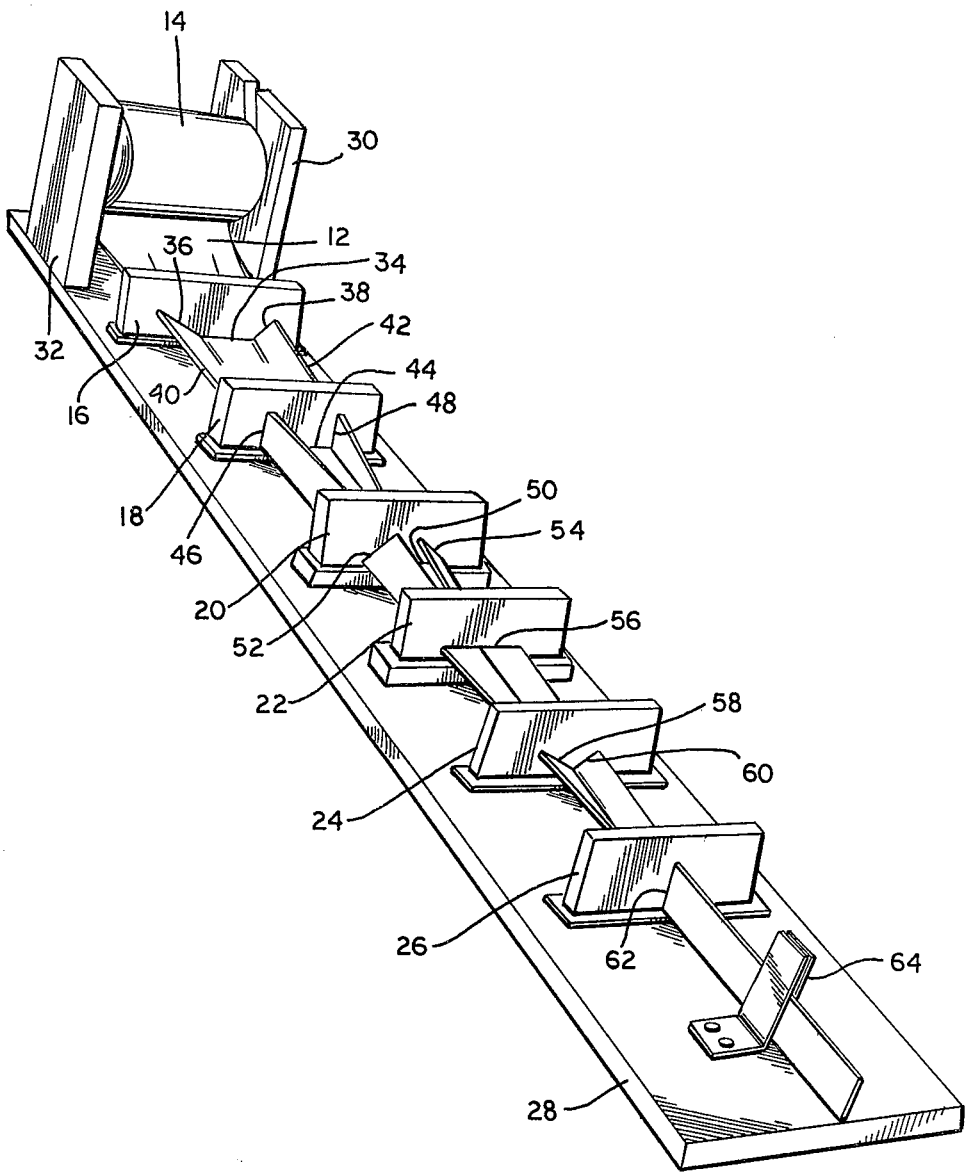
14
30
12
36
34
38
42
32
44
40
48
16
18
50
54
46
20
56
52
22
58
60
24
26
62
64
28

PAPER FOLDING APPARATUS

DESCRIPTION

Field

The present invention generally relates to apparatus for folding paper and, more particularly, to apparatus for folding a relatively narrow flat paper web to a shape for use in binding the end of a set of blueprints or the like.

BACKGROUND OF THE INVENTION

It is customary in the blueprint art to bind one edge of a set of blueprints with a strip of folded paper. Such paper binders may be formed by cutting a desired shape from a flat sheet of paper or by cutting a desired length from an elongate roll of paper to provide a paper web. The folding operation has been traditionally performed manually by making at least three longitudinal folds in the paper web to form a generally U-shaped paper binder of double thickness. The paper binder is then stapled or otherwise attached to one edge of a stack of blueprints or the like. Manual folding of the paper web, however, is inefficient and time consuming.

U.S. Pat. No. 4,089,514 (incorporated herein by reference) to Skipworth discloses apparatus for folding paper in a manner suitable for use as a paper binder for blueprints. The apparatus comprises folding channels of complex shape and design. The apparatus also includes drive rolls and creasing rolls. The folding channels and rollers are relatively expensive and difficult to manufacture.

BRIEF DESCRIPTION OF THE INVENTION

The present invention generally relates to apparatus for a folding a web product. More particularly, the present invention generally comprises a plurality of die members for passing therethrough a paper web dispensed from a roll. The die members have slots formed therein and are sequentially arranged such that the slots guide the paper web to progressively form distinct folds as the web is passed through the die members.

Accordingly, it is an object of the present invention to provide an improved paper folding apparatus.

Another object of the present invention is to provide a paper folding apparatus which does not require precision machined and complex parts.

A further object of the present invention is to provide paper folding apparatus which can be hand operated.

These and other objects, features and advantages of the present invention will become apparent from a review of the following detailed description of the disclosed embodiment and the appended drawing and claims.

BRIEF DESCRIPTION OF THE DRAWING

The drawing is a pictorial view of a disclosed embodiment of the paper folding apparatus of the present invention.

DETAILED DESCRIPTION OF THE DISCLOSED EMBODIMENT

Referring now to the drawing, it will be seen that there is a generally rectilinear apparatus 10 for folding a paper web 12 dispensed from an roll 14 thereof. The folding apparatus 10 generally comprises six die members 16, 18, 20, 22, 24, 26 attached to a base 28. The roll 14 is rotatably supported above the base 28 between two brackets 30, 32 so that the paper web 12 may be continuously dispensed from the roll in a direction parallel to the length of the base. When the paper web 12 is initially dispensed from the roll 14, the paper web is substantially flat and forms an imaginary horizontal plane.

After the paper web 12 is dispensed from the roll 14, it is passed through slots formed in the die members 16–26. The die members may be made from any suitable material, such as wood or the like. Similarly, the slots formed in the die members may be formed by any suitable means, such as by sawing, routing or the like. The slots should provide a sufficiently wide opening in the die members so that multiple thicknesses of the paper web 12 may be passed therethrough.

The first die member 16 is disposed on the base 28 adjacent the roll 14. The die member 16 has three interconnecting slots 34, 36, 38 formed therein. The slot 34 is substantially parallel to the horizontal plane of the paper web 12 and extends approximately one-half the width of the paper web. The slots 36, 38 extend upwardly from each end of the slot 34 at an angle of approximately 45° thereto. The length of each slot 36, 38 is approximately one-fourth the width of the paper web 12. It will be appreciated that when the paper web 12 is passed through the slots 34–38 in the first die member 16, the outer one-fourth of the paper web is folded upwardly from the horizontal plane at an angle of approximately 45° with the edges 40, 42 of the paper web being folded toward each other.

The second die member 18 is disposed adjacent the first die member 16 such that the first die member is intermediate the second die member and the roll 14. The second die member 18 has three interconnecting slots 44, 46, 48 formed therein. The slot 44 is substantially parallel to the horizontal plane of the paper web 12 and extends approximately one-half the width of the paper web. The slot 44 is also in axial alignment with the slot 34. The slots 46, 48 extend upwardly sustantially vertically from each end of the slot 44 at an angle of approximately 90° thereto. The length of each slot 44 is approximately one-fourth the width of the paper web 12. When the paper web 12 is passed through the slots 44–48 in the second die member 18, the outer one-fourth of the paper web is folded upwardly from the horizontal plane at an angle of approximately 90°.

The third die member 20 is disposed adjacent the second die member 18 such that the second die member is intermediate the third die member and the first die member 16. The third die member 20 has three interconnecting slots 50, 52, 54 formed therein. The slot 50 is substantially parallel to the horizontal plane of the paper web 12 and extends approximately one-half the width of the paper web. The slot 50 is also in axial alignment with the slots 34, 44. The slots 52, 54 extend upwardly from each end of the slot 50 at an angle of approximately 135° thereto. The length of each slot 52, 54 is approximately one-fourth the width of the paper web 12. When the paper web 12 is passed through the slots 50–54 in the third die member 20, the outer one-fourth of the paper web is folded upwardly from the horizontal plane at an angle of approximately 135°.

The fourth die member 22 is disposed adjacent the third die member 20 such that the third die member is intermediate the fourth die member and the second die member 18. The fourth die member 22 has a single slot 56 formed therein. The slot 56 is substantially parallel to the horizontal plane of the paper web 12 and extends approximately one-half the width of the paper web. The slot 56 is also in axial alignment with the slots 34, 44, 50. When the paper web 12 is passed through the slot 56, after first having passed through the first three die members 16–20, the outer one-fourth of the paper web is folded substantially horizontal so that the edges 40, 42 overlie the central portion of the paper web. When the paper web 12 has passed through the fourth die member 22, the first two longitudinal folds of the paper web are complete.

The fifth die member 24 is disposed adjacent the fourth die member 22 such that the fourth die member is intermediate the fifth die member and the third die member 20. The fifth die member 24 has two interconnecting slots 58, 60 formed therein. the slots 58, 60 each extend upwardly from the horizontal plane of the paper at an angle of approximately 45°. Furthermore, the slot 58 intersects the slot 60 at an angle of approximately 90°. Each slot 58, 60 is approximately one-fourth the width of the paper web 12 or approximately one-half the width of the twice folded paper web. When the twice folded paper web 12 is passed through the slots 58, 60, the twice folded paper web is folded approximately in half upwardly at an angle of approximately 45° to the horizontal plane of the paper web.

The sixth die member 26 is disposed adjacent the fifth die member 24 such that the fifth die member is intermediate the sixth die member and the fourth die member 22. The sixth die member 26 has a single substantially vertical slot 62 formed therein. The vertical slot 62 is approximately one-fourth the width of the paper web 12 or approximately one-half the width of the twice folded paper web. When the twice folded paper web 12 passes through the slot 62 in the sixth die member 26, the twice folded paper web is folded onto itself thereby completing the third longitudinal fold. It will be appreciated by those skilled in the art that the thrice folded paper web 12 is a double thickness of an essentially U-shape which is ready for use as a paper binding strip when cut to a desired length.

The spacing of the die members 16–26 on the base 28 should be such that the paper web passes smoothly therebetween and does not buckle or crease.

In order to facilitate cutting of the thrice folded paper web 12, a cutting bracket 64 is attached to the base 28 adjacent the sixth die member 26 such that the sixth die member is intermediate the cutting bracket and the fifth die member 24. The cutting bracket 64 is made of any suitable material, such as metal, and is preferably bent into a U-shape so that the thrice folded paper web 12 will pass through the bracket. The cutting bracket 64 may optionally be provided with a sharpened or serrated cutting edge to make cutting of the folded paper web easier.

Operation of the paper folding apparatus 10 will now be considered. The apparatus 10 is placed on a flat surface, such as a table. A roll 14 of paper is placed in the brackets 30, 32. The paper web is threaded through the slots in the die members 16–26 and through the cutting bracket 64. When a length of paper binding material is desired, the end of the paper web 12 protruding from the cutting bracket 64 is grasped, for example by the hand, and pulled until a desired length has been drawn past the cutting bracket. The thrice folded paper web 12 is then cut by tearing the folded paper web across the cutting edge of the cutting bracket 64 in a motion similar to tearing off a piece of adhesive tape from its well known tape dispenser. The folded paper web is then ready for attachment in the normal manner to an edge of a stack of blueprints or the like.

It should be understood, of course, that the foregoing relates only to a preferred embodiment of the present invention and that numerous modifications or alterations may be made therein without departing from the spirit and the scope of the invention as set forth in the appended claims.

I claim:

1. Apparatus for longitudinally folding a paper web, said apparatus comprising:

means for holding and longitudinally dispensing a paper web from a roll;

a plurality of discrete die means for longitudinally passing said paper web through die openings in each of said die means, said die openings being in axial alignment with said longitudinally dispensed paper web, and said die openings being shaped such that distinct folds are progressively made in said paper web as said paper web is passed through said die means;

wherein said paper web has a substantially horizontal folding plane, a central portion and longitudinal edges and wherein said plurality of discrete die means comprises:

a first die having slots therein for passing said paper web therethrough, said slots being shaped to fold the edges of said paper web approximately 45° from said plane inwardly toward each other, a second die having slots therein for passing said paper web therethrough, said slots being shaped to fold the edges of said paper web approximately 90° from said plane inwardly toward each other;

a third die having slots therein for passing said paper web therethrough, said slots being shaped to fold the edges of said paper web approximately 135° from said plane inwardly toward each other;

a fourth die having a slot therein for passing said paper web therethrough, said slot being shaped to fold the edges of said paper web approximately 180° from said plane inwardly toward each other so that said edges overlie said central portion of said paper web to thereby form a folded paper web having longitudinal folded edges;

a fifth die having slots therein for passing said folded paper web therethrough, said slots being shaped to fold said folded edges approximately 45° from said plane inwardly toward each other; and a sixth die having a slot therein for passing said folded paper web therethrough, said slot being shaped to fold said folded edges approximately 90° from said plane inwardly toward each other such that said folded edges overlie each other.

2. Apparatus of claim 1 further comprising means for cutting said paper web after said paper web has been folded.

* * * * *